US009816765B2

(12) United States Patent
Rampp

(10) Patent No.: US 9,816,765 B2
(45) Date of Patent: Nov. 14, 2017

(54) PIPING MODULE FOR AIR FRACTIONATION PLANT

(71) Applicant: LINDE AKTIENGESELLSCHAFT, Munich (DE)

(72) Inventor: Augustin Rampp, Iffeldorf (DE)

(73) Assignee: Linde Aktiengesellschaft, Munich (DE)

( * ) Notice: Subject to any disclaimer, the term of this patent is extended or adjusted under 35 U.S.C. 154(b) by 616 days.

(21) Appl. No.: 13/871,178

(22) Filed: Apr. 26, 2013

(65) Prior Publication Data

US 2013/0283855 A1 Oct. 31, 2013

(30) Foreign Application Priority Data

Apr. 27, 2012 (DE) ..... 10 2012 008 416

(51) Int. Cl.
*F28F 7/00* (2006.01)
*F25J 3/04* (2006.01)
*F25J 1/00* (2006.01)

(52) U.S. Cl.
CPC ..... *F28F 7/00* (2013.01); *F25J 1/0012* (2013.01); *F25J 3/04018* (2013.01); *F25J 3/0489* (2013.01); *F25J 2290/42* (2013.01); *Y10T 29/49826* (2015.01)

(58) Field of Classification Search
CPC ..... F25J 3/04018; F25J 3/0409; F25J 3/0489
USPC ..... 62/617
See application file for complete search history.

(56) References Cited

U.S. PATENT DOCUMENTS 5,461,871 A 10/1995 Bracque et al.
2001/0015419 A1* 8/2001 Yagi et al. ..... 251/151
2003/0089126 A1* 5/2003 Stringer et al. ..... 62/643
2004/0050095 A1 3/2004 Brigham et al.
2007/0101762 A1 5/2007 Schaub et al.
2009/0320520 A1* 12/2009 Parsnick et al. ..... 62/648
(Continued)

FOREIGN PATENT DOCUMENTS

DE 10342788 A1 4/2005
EP 0629829 A1 12/1994

OTHER PUBLICATIONS

Search Report of Corresponding European Application No. 12004687 (dated Dec. 11, 2012).
(Continued)

*Primary Examiner* — Frantz Jules
*Assistant Examiner* — Brian King
(74) *Attorney, Agent, or Firm* — Millen White Zelano & Branigan, P.C.

(57) ABSTRACT

A piping module is described which comprises at least two fluid connections or ports for connection to at least one main heat exchanger of an air fractionation plant, whereby the main heat exchanger becomes linked to at least two fluid lines in a warm part of the air fractionation plant. The piping module comprises at least two ports on the main compressor side, couplable to at least two fluid lines in the warm part of the air fractionation plant, and at least two ports on the main heat exchanger side, couplable to at least two fluid ports of the at least one main heat exchanger, and at least two fluid lines connecting the ports on the main compressor side to the ports on the main heat exchanger side. A corresponding air fractionation plant and a method for erecting such an air fractionation plant (100) are likewise described.

12 Claims, 1 Drawing Sheet

(56) References Cited

U.S. PATENT DOCUMENTS

| | | | | |
|---|---|---|---|---|
| 2010/0242538 | A1* | 9/2010 | Prosser et al. | 62/646 |
| 2010/0287986 | A1* | 11/2010 | Jibb et al. | 62/640 |
| 2011/0192194 | A1* | 8/2011 | Howard | 62/644 |

OTHER PUBLICATIONS

"Skid-Mounted Oxygen-Nitrogen Plant Type SK145", Publication BOC Cryoplants, BOC Cryoplants Engineering Centre (Sep. 1, 1991) XP-001223907.

* cited by examiner

PIPING MODULE FOR AIR FRACTIONATION PLANT

The invention relates to a piping module for at least one main heat exchanger of an air fractionation plant, to an air fractionation plant with such a piping module and to a method for erecting an air fractionation plant.

BACKGROUND OF THE INVENTION

Atmospheric air is a gas mixture which is substantially composed of nitrogen (78%), oxygen (21%) and argon (0.9%). The remaining 0.1% primarily comprises carbon dioxide together with the noble gases neon, helium, krypton and xenon as further components.

Plants for air fractionation by rectification (hereinafter "air fractionation plants" for short) are known. They are used for producing gaseous oxygen and nitrogen and optionally liquid oxygen, liquid nitrogen and the stated noble gases. Air fractionation comprises the essential steps of compression, precooling, purification, cooling and rectification.

Compression proceeds for example in multistage turbocompressors with intermediate cooling and post-cooling to a pressure of approx. 6 bar or above. Prior to compression, dust particles may be removed in "intensive" filters.

Subsequent precooling may be performed in water-operated direct-contact coolers, in which water-soluble impurities may in part be washed out. The water used may, for example, be recooled in evaporative trickle coolers against residual gaseous nitrogen from rectification (hereinafter also denoted "cooled nitrogen").

The precooled air is generally purified in molecular sieve absorbers, in which moisture, carbon dioxide and hydrocarbons are removed.

The air purified in this manner is liquefied by being cooled to approx. −175° C. in one or more main heat exchangers. Cooling proceeds by internal heat exchange countercurrently to the cold gas streams produced in the plant. In this case too, at least residual gaseous nitrogen from rectification is generally used. On subsequent expansion, the air cools further due to the Joule-Thomson effect and liquefies.

The actual fractionation (rectification) of the air proceeds in separation columns (rectification columns) of a separation column system, an oxygen-rich bottoms fraction and a nitrogen-rich overhead fraction initially being produced. Depending on the requisite purity of the final products and/or on the gases to be produced, different column configurations may be used for the separation column system. For example, two separation columns may be used as double columns in the form of "medium pressure" and "low-pressure" columns. Noble gases such as argon and/or neon may be produced by downstream separation columns and method steps. Rectification may also for example involve liquefaction of pure nitrogen against vaporizing oxygen and recycling thereof into the separation column system. Corresponding plants may also comprise further apparatuses such as for example additional or post-compressors, expansion turbines, high-pressure heat exchangers, internal compression pumps and/or liquid separators.

Air fractionation plants are thus made up of a "warm" part, which contains the components for compression, precooling and purification, and a "cold" part, which contains the main heat exchanger(s) and optionally further heat exchangers, for example, a countercurrent supercooler, and the separation column system. The components in the cold part may be arranged in one or more "cold boxes". These are jacketed steel frames which are filled with insulating material such as perlite in order to reduce input of heat from the surroundings. The interior of a cold box is ideally maintenance free. Components which require maintenance may to this end be sealed off from the insulating material and be arranged to be accessible from the outside. Valves may extend towards the outside in order for example to make the drives thereof accessible (i.e., the valves are near the wall of the cold box so that their drives can extend through the cold box). Moisture penetration may be prevented by flushing the interior of the cold box with nitrogen.

Depending on the size of the plant, a plurality of components may be integrated in a common cold box. In relatively small plants, for example, the main heat exchanger(s) and the separation column system may be combined in one cold box, while in larger plants these components are distributed between a plurality of cold boxes. Large plants may also comprise a plurality of main heat exchangers which are accommodated in separate cold boxes. Further cold boxes, for example a plurality of column boxes and/or "argon boxes" (in plants for obtaining argon) may also be provided.

Gaseous oxygen and nitrogen obtained in an air fractionation plant may be fed into a pipework system and delivered directly to the consumer. Oxygen, nitrogen and argon in liquid form are held in intermediate storage for example in storage tanks and transported to the site of use in tankers.

Corresponding air fractionation plants should preferably be present at the site of use for the respective gases, thus for example in the vicinity of refineries or petroleum deposits in order to keep transport distances for the stated fluids as short as possible.

Air fractionation plants are here generally assembled from prefabricated components. This is, however, frequently problematic as sufficiently skilled assembly personnel are either not available or are costly. This in particular applies to linking of the main heat exchangers. There is therefore a need for improvements which enable more reliable and simpler erection of air fractionation plants.

SUMMARY OF THE INVENTION

Against this background, the present invention proposes a piping module for at least one main heat exchanger of an air fractionation plant, an air fractionation plant with such a piping module, wherein by means of the piping module, at least two fluid ports (connections) of at least one main heat exchanger, constructed for use in an air fractionation plant, are linkable to at least two fluid lines in a warm part of the air fractionation plant. The piping module comprises at least two ports on the main compressor side, which are couplable with the at least two fluid lines in the warm part of the air fractionation plant, and at least two ports on the main heat exchanger side, which are couplable with the at least two fluid ports of the at least one main heat exchanger, and at least two fluid lines connecting the at least two ports on the main compressor side and the at least two ports on the main heat exchanger side.

Upon further study of the specification and appended claims, other objects, aspects and advantages of the invention will become apparent.

The invention proposes a piping module by means of which at least two fluid connections or ports of at least one main heat exchanger constructed for use in an air fractionation plant are linkable to at least two fluid lines in a warm part of the air fractionation plant. The piping module comprises at least two ports on the main compressor side which are couplable with the at least two fluid lines in the warm part of the air fractionation plant, and at least two ports on the main heat exchanger side which are couplable with the at least two fluid ports of the at least one main heat exchanger, and at least two fluid lines which link the at least two ports on the main compressor side and the at least two ports on the main heat exchanger side.

The piping module proposed according to the invention makes it possible to replace the "header piping" which is conventionally required for the main heat exchanger in air fractionation plants. The header piping conventionally serves to link the main heat exchanger to the stated warm part of the plant and is arranged on the upper side of the main heat exchanger(s).

The main heat exchanger(s) of an air fractionation plant serve at least for cooling the feed air provided for fractionation in the separation columns of the air fractionation plant countercurrently to at least one air product produced from the feed air. The main heat exchanger(s) are thus arranged for cooling air by indirect heat exchange with backflow from the separation column system and have appropriately arranged means which comprise, for example, suitably constructed lines.

Air fractionation plants may also be arranged for "internal" compression, in which a liquid stream is drawn off from one or more separation columns, adjusted to pressure as a liquid, and vaporized in the main heat exchanger(s) against a heat-transfer medium, generally a compressed air stream, to yield a gaseous compressed product. If a corresponding liquid stream is at supercritical pressure, it is not vaporization, but instead pseudo-vaporization which occurs. The heat-transfer medium used for the vaporization or pseudo-vaporization, for example, an appropriate compressed air stream, is compressed for thermodynamic reasons to a pressure which is generally distinctly above a pressure which is used as an operating pressure in the separation column system. It is liquefied in the main heat exchanger(s) (or optionally pseudo-liquefied, if a supercritical pressure prevails). Main heat exchangers are thus also used for providing a corresponding gaseous compressed product.

A plurality of main heat exchangers are in particular used for reasons of space or due to structural considerations, for example, when a main heat exchanger required for an air fractionation plant cannot be arranged in an individual cold box and/or fabrication and/or transport would otherwise constitute an insuperable expense.

The main heat exchanger(s) of an air fractionation plant may in each case be formed from one or more main heat exchanger blocks or main heat exchanger sections connected in parallel and/or in series, for example from one or more plate heat exchanger blocks.

Where it is stated below that a plurality of main heat exchangers are provided, this should be taken to mean a plurality of separate units but which in each case in principle perform the same functions. All the main heat exchangers are, for example, passed through by the same number of fluid lines and cool or heat them substantially to the same temperatures. These thus comprise a plurality of units, which can be connected in parallel and are consequently capable of performing the function of a larger main heat exchanger.

Where, on the other hand, a plurality of main heat exchanger blocks are mentioned below, this should be taken to mean a plurality of separate units which, however, perform different functions. They may, for example, be a plurality of separate plate heat exchanger blocks through which in each case different fluids may be passed. For example, for the purposes of the mentioned internal compression, the heat-transfer medium to be liquefied (or pseudo-liquefied) and the internally compressed stream (or plurality of streams) to be vaporized (or pseudo-vaporized) may be guided contrary to one another in indirect heat exchange in a separate plate heat exchanger. Separate plate heat exchanger blocks, which must be designed for lower pressures, may be used for the remaining streams to be cooled and to be heated. A plurality of main heat exchanger blocks together performs the function of a main heat exchanger. A plurality of main heat exchangers may in each case comprise an identical set of main heat exchanger blocks. The individual main heat exchanger blocks may also be arranged in different cold boxes.

The main heat exchanger(s) are themselves (optionally with their separate main heat exchanger blocks) part of the above-explained "cold" part of an air fractionation plant, but are constructed for linking to the warm part thereof. The main heat exchanger(s) do in any event fundamentally differ from the heat exchangers or coolers (for example a post-cooler of one or more compressors) arranged in the warm part of the air fractionation plant in that at least one fluid cooled to cryogenic temperatures is supplied to and/or drawn from them. A cryogenic temperature is for example below −50° C., in particular below −100° C. The main heat exchanger(s) are therefore arranged for operation at corresponding low temperatures by, for example, comprising or being produced from materials which are capable of withstanding cryogenic temperatures. They are thus arranged structurally, for the purposes of fabrication and functionally at least to cool the feed air intended for fractionation in the separation columns of the air fractionation plant countercurrently to at least one air product produced from the feed air.

In contrast, upstream from the main heat exchanger(s), i.e. in the warm part of the plant, use is generally exclusively made of heat exchangers or coolers which have fluids adjusted to a higher temperature supplied to or drawn from them. These generally have a temperature of at least 0° C. Accordingly, the air compressed in a main compressor is conventionally cooled by means of at least one cooler, for example a water cooler, in order to dissipate the heat of compression. However, cooling here proceeds entirely at temperatures of above 0° C., thus not at cryogenic temperatures and/or not countercurrently to at least one air product produced from the feed air.

For the purposes of the present application, the main compressor is the compressor or compressor arrangement which is the only machine to be driven with external energy and, for example, takes the form of a single-stage or multistage compressor, all the stages of which are connected to the same drive. All the stages may be accommodated in a single housing or be connected by a transmission. Post-compressors are frequently not included among the machines driven with external energy, since they are driven by expansion machines which are in each case associated therewith. The "warm" part of the air fractionation plant, which is linked by means of the piping module according to the invention to the main heat exchanger(s), comprises this main compressor as its central component, but may however comprise further devices such as post-compressors and/or purification devices and/or product compressors (for external compression of air products).

Erection of the header piping proves particularly costly when, as explained above, a plurality of main heat exchangers and/or a main heat exchanger with a plurality of main heat exchanger blocks are provided for an air fractionation plant. In this case, the pipes on corresponding main heat exchangers and/or main heat exchanger blocks or the cold boxes enclosing them must be assembled at the erection site of the air fractionation plant in order in each case to produce a link to common fluid lines. Prefabricating the header piping per se is possible only with difficulty since tolerances are frequently too large in practice. In other words, it is for example virtually impossible to produce a main heat exchanger and/or main heat exchanger block with the degree of precision which permits direct fitting of one or more prefabricated header lines. The pipes which open directly into the main heat exchangers and/or main heat exchanger blocks, corresponding collectors and the transfer lines for linking further components, for example the upstream compression and purification devices as explained above, must therefore be fabricated on site in a very costly manner.

In contrast, the invention proposes transferring the stated pipes from the roof of the main heat exchanger(s) and/or main heat exchanger blocks or the corresponding cold boxes into the piping module in the form of a "piping skid". The piping module may be arranged vertically beside the main heat exchanger(s) and/or main heat exchanger blocks. At the erection site of the air fractionation plant, all that remains to do is to fabricate connections between the main heat exchanger(s) and/or main heat exchanger blocks and the piping module in order to produce a connection with the respective fluid lines. This is generally non-critical in comparison with the previously explained custom fabrication.

The piping module provided according to the invention is distinguished in that it primarily, in particular exclusively, comprises lines (fluid lines) constructed for conveying fluids. A piping module is constructed with ports on the main compressor side for linking to a warm part of the air fractionation plant and with ports on the main heat exchanger side for linking to the cold part thereof, more accurately to the main heat exchanger(s) and/or main heat exchanger blocks or the ports thereof.

A piping module for example comprises to this end n ports on the main compressor side and n×m ports on the main heat exchanger side, wherein m represents the number of main heat exchangers which can be linked to the piping module and amounts for example to 1, 2, 3, 4, 5, 6, 7, 8, 9 or 10. The ports on the main compressor side and the ports on the main heat exchanger side are connected to one another via the stated fluid lines. Where n>1, a plurality of ports on the main heat exchanger side may in each case be connected via a fluid manifold with a port on the main compressor side. A piping module optionally comprises shut-off means for shutting off individual fluid lines and/or adjusting means for adjusting a fluid stream, in particular for uniformly dividing fluid of a port on the main compressor side among m ports on the main heat exchanger side, but no means which actively influence pressure and/or temperature, i.e. compressors, expansion valves or expansion machines, heating devices, coolers, heat exchangers and the like.

A piping module according to the invention is thus constructed structurally such that a, in particular each, fluid stream guided through the piping module leaves at an outlet pressure and/or an outlet temperature which substantially corresponds respectively to the inlet pressure or inlet temperature.

A fluid stream which is either fed into the piping module via a port on the main compressor side and withdrawn via a port on the main heat exchanger side (or m ports on the main heat exchanger side) or vice versa, has a substantially identical pressure and substantially identical temperature when withdrawn as when fed in. A "substantially" identical pressure and a "substantially" identical temperature may involve, for example, slight pressure rises or pressure drops and/or slight temperature increases or temperature decreases which may for example respectively amount to less than 1 bar, 0.5 bar or 0.1 bar or less than 10° C., 5° C. or 1° C. and may for example arise due to conduction losses and/or input of heat from or dissipation of heat into the surroundings.

The ports "on the main compressor side" are distinguished in that they are arranged for linking to a warm part of the air fractionation plant. The ports "on the main heat exchanger side", on the other hand, are arranged for linking to the main heat exchanger(s) and/or main heat exchanger blocks or the ports thereof. If, as explained, m main heat exchangers are provided, the number of ports on the main compressor side differs from the number of ports on the main heat exchanger side. For linking to the main heat exchanger(s) and/or main heat exchanger blocks, the ports are in particular arranged in that they comprise a respectively suitable spatial arrangement and/or location. As explained, the piping module according to the invention is in particular used for header piping (or partial replacement thereof). The ports on the main heat exchanger side are therefore preferably arranged above the piping module. Arrangement "above" or "below" is defined, for example, relative to a mounting structure which bears the piping module and comprises corresponding supporting feet or structures on the underside thereof.

In contrast with prefabricated header piping as mentioned above, the piping module enables adaptation in three dimensions of the connecting pipes between the respective ports (connection pieces) of the main heat exchanger(s) and/or main heat exchanger blocks and the piping module. The piping module advantageously here comprises ports on the upper side thereof, namely the stated ports on the main heat exchanger side, which correspond to and are couplable with ports of the at least one of the main heat exchanger(s) and/or main heat exchanger blocks.

A piping module according to the invention may be completely prefabricated, i.e., for example, painted, pressure-tested, insulated, instrumented and wired. Appropriate testing and monitoring equipment is generally available at the fabrication site which permit safety acceptance testing at the fabrication site. In this way it is possible to avoid, for example, damage or fabrication errors requiring costly repairs or, in an extreme case, return to the manufacturer, only being discovered at the erection site of the air fractionation plant.

Using a piping module according to the invention can also significantly improve the planning and design of an air fractionation plant. The piping module according to the invention provides a structure for the layout of a corresponding plant and specifies a definite design. This means the plant can largely be erected from standardized modules with corresponding ports which fit together with one another in the manner of a modular system which can be extended as desired.

Considerable quantities of pure gases are in particular required for refineries, tertiary petroleum recovery (enhanced oil recovery) and steel works. The air throughput of the largest plants for producing nitrogen for enhanced oil recovery amounts to approx. 500,000 normal cubic meters of air per hour, while plants with production volumes of approx. 860,000 normal cubic meters of oxygen per hour are under construction for refineries. Piping modules according to the invention for plants with an air throughput of at least 200,000 normal cubic meters of air per hour can be transported without any problem.

The main heat exchangers for plants of such a size or corresponding main heat exchanger blocks of the requisite performance can only be produced at a few specialized fabrication sites. This is also due to the manufacturing technology used for such apparatus. In particular, vacuum-brazed aluminum plate heat exchangers are particularly advantageous for the stated plants. Such heat exchangers are produced in vacuum furnaces without the use of fluxes. This method requires high quality fabrication as the brazing solder which is used for joining has a melting point which differs only slightly from that of the materials to be joined.

However, in order to achieve maximum performance, correspondingly stringent assembly quality requirements must also be met for the piping. In particular, improper welding may significantly impair the performance of the main heat exchangers, and thus of the entire air fractionation plant. In particular, the requisite stress-free assembly of the pipes causes difficulties. Considerable damage may occur in extreme cases.

The piping module according to the invention significantly simplifies the piping of such main heat exchangers, such that the personnel used need not be so highly skilled as is conventionally necessary, or alternatively highly skilled personnel need only be used for a shorter period of time.

As has already been addressed in part, a piping module according to the invention is advantageously constructed for linking at least two main heat exchangers and/or main heat exchanger blocks. This enables particularly flexible erection of air fractionation plants which can be adapted to the particular performance requirements which apply.

For each gas application, there is an optimum economic viability for gas supply which is dependent on numerous constraints. Air fractionation by rectification generally makes sense from a requirement of just 200 normal cubic meters of nitrogen or 1,000 normal cubic meters of oxygen per hour. Starting from these values going up to the previously mentioned maximum outputs, there is a very large range of production volumes which have to be met by air fractionation plants. In particular, it has not hitherto been possible to erect the main heat exchangers used in any desired size. Even below the maximum size defined by mechanical limits, producing very large main heat exchangers frequently does not make economic sense. In these cases, as mentioned, it is necessary to use a plurality of main heat exchangers or main heat exchanger blocks (for example arranged in corresponding cold boxes) and to supply them jointly with air from the warm zone of the plant. It is precisely in such cases that a piping module capable of being appropriately connected to a plurality of main heat exchangers and/or main heat exchanger blocks makes sense.

As explained, the piping modules according to the invention are advantageously equipped to this end with at least one fluid manifold. A "fluid manifold" should here be taken to mean a pipe arrangement which permits the connections of a plurality of main heat exchangers and/or main heat exchanger blocks or a plurality of connections of one main heat exchanger to be linked to a common line. A fluid manifold here assists in providing a plurality of sets of ports corresponding in each case to the main heat exchangers to be linked, wherein, as explained, for example n ports on the main compressor side and n×m ports on the main heat exchanger side are provided.

Such a fluid manifold may advantageously be constructed as a module. A piping module may therefore be assembled, for example, at the fabrication site from a base module and a corresponding fluid manifold module. It makes sense for the base module additionally to contain components which are conventionally assembled in the field on site. This means that corresponding modules may largely be mass produced and prefabricated, after which they then merely need to be assembled as required. This enables efficient and timely erection of piping modules.

Advantageously, a separate set of ports on the main heat exchanger side is provided for each main heat exchanger and/or main heat exchanger block, which set of ports comprises at least one feed line for compressed, prepurified and precooled air and a discharge line for cooled nitrogen. The main heat exchangers or main heat exchanger blocks used in the explained air fractionation plants comprise a series of lines which guide fluid streams in both directions through the main heat exchangers or main heat exchanger blocks. The lines terminate at the upper side of the main heat exchangers or main heat exchanger blocks in one or more connection pieces. A plurality of connection pieces are combined in the explained fluid manifold, which according to the invention is part of the piping module. The stated feed and discharge lines are provided for this purpose.

In air fractionation plants of the above-explained kind, corresponding product streams, which are guided countercurrently to the air fed to the plant from the warm part through the main heat exchanger, pass through the main heat exchanger. A set of ports on the main heat exchanger side may also comprise further discharge lines, for example, for oxygen, product nitrogen and/or noble gases. If an additional high-pressure heat exchanger (which is to be linked to a corresponding post-compressor or recycle compressor) is provided in the air fractionation plant, corresponding lines may also be provided for this purpose in a set of lines.

In corresponding sets of ports, the corresponding ports are advantageously spatially arranged such that maximally simple and direct linking of the main heat exchanger(s) is ensured. Such an identical spatial arrangement may here be standardized such that a plurality of different modules (in the manner of the above-mentioned modular system) may be connected to one another without costly adaptations. The spatial arrangement does, however, enable three-dimensional adaptation of corresponding connection lines at least to a certain extent, for example so that tolerances of modules and foundations may be compensated.

It is therefore in turn possible to use prefabricated connection pipes, optionally with correspondingly standardized flanges, for connecting the piping module to the main heat exchanger(s). This reduces the assembly steps which are required. These too are, however, also adaptable at least to a certain extent.

A piping module according to the invention advantageously also comprises fire-protected oxygen transfer valves. Corresponding necessary fire barrier means may likewise be prefabricated together with the remaining components of the piping module and thus be transferred to the erection site of the air fractionation plant in prefabricated and optionally appropriately tested form. A conventional barrier provided by a concrete wall is not necessary.

In one particularly preferred development, an explained piping module, optionally with a previously explained fluid manifold which is integrated and/or of modular construction, is configured for vertical arrangement beside the at least one main heat exchanger or a corresponding main heat exchanger block. This enables, on the one hand, space-saving piping of one or more main heat exchangers and, on the other hand, simple prefabrication and a unproblematic transport. Piping modules which may be arranged vertically may be of flat construction in a horizontal direction and therefore prefabricated horizontally. The requisite assembly space is therefore considerably reduced in comparison with conventional arrangements.

The air fractionation plant which is likewise provided according to the invention benefits from the above-stated advantages, to which reference may therefore explicitly be made.

A method according to the invention for erecting an air fractionation plant involves provision of at least one main heat exchanger and a piping module according to the invention and linkage of the at least one main heat exchanger to the piping module. The stated components are preferably prefabricated. The stated advantages are likewise achieved as a result.

It goes without saying that the above-mentioned features and those still to be explained below may be used not only in the respectively stated combination but also in other combinations or alone, without going beyond the scope of the present invention.

BRIEF DESCRIPTION OF THE DRAWINGS

The invention is illustrated schematically by an exemplary embodiment in the attached drawings and is described in detail below with reference to the drawings, wherein.

In the figures, identical or equivalently acting elements optionally bear identical reference signs and, for clarity's sake, are not repeatedly explained.

Figure 1:
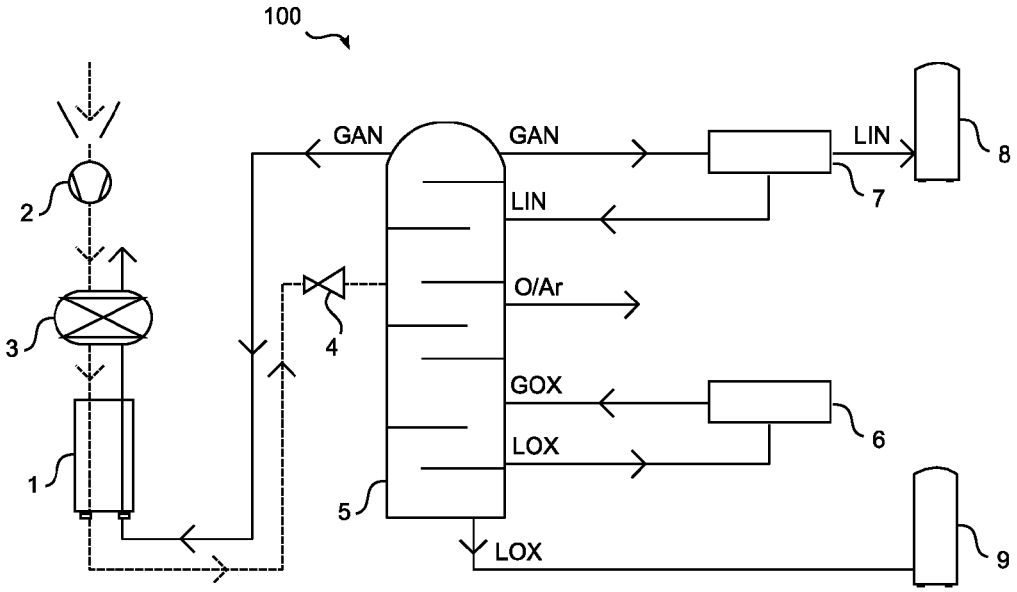
FIG. 1 shows a greatly simplified, schematic diagram of an air fractionation plant according to the prior art.

FIG. 1 shows a greatly simplified, schematic diagram of an air fractionation plant according to the prior art. This is designated overall as 100. The present invention relates in particular to linking a main heat exchanger in such an air fractionation plant 100 to the "warm" part of the fraction plant which includes the main compressor. The main heat exchanger is provided in the form of a main heat exchanger module 1.

An air stream represented as a dashed line and which has previously been compressed in a compressor 2 and purified in an adsorber 3, is supplied to the main heat exchanger in the main heat exchanger module 1, which may comprise one or more main heat exchanger blocks in a corresponding cold box. Additional devices such as filters and the like are not shown. Although FIG. 1 shows only one adsorber 3, an air fractionation plant 100 conventionally comprises a plurality of adsorbers 3, which are operated alternately and appropriately regenerated.

In the main heat exchanger, the compressed and purified air which has been supplied is countercurrently cooled in the main heat exchanger module 1 with cold, gaseous nitrogen (GAN) from the top of a separation column 5 which is explained below.

The air stream, which is cooled close to liquefaction temperature in main heat exchanger module 1, is then expanded in an expansion valve 4 and fed in partially liquid form into a central zone of the separation column 5. A corresponding plant may additionally include post-compression of a (sub-) stream of air and cooling in a high-pressure heat exchanger. This is also not shown for clarity's sake. As has already been explained, instead of a single separation column 5, as shown in FIG. 1, it is also possible to use a plurality of series-connected separation columns, double columns and the like, as the separation column system.

The liquefied air is fractionated by using the different boiling points of its constituents. In the separation column 5, the liquid air is, to this end, trickled down via a number of sieve trays (shown in greatly simplified form) countercurrently to non-liquefied, ascending air. The liquid here accumulates on the trays where ascending vapor bubbles pass through the accumulated liquid. As a result, primarily the higher boiling oxygen liquefies out of the gas stream, while the lower boiling nitrogen preferentially vaporizes out of the liquid droplets. For this reason, gaseous nitrogen (GAN) collects at the cold top of the separation column 5 and liquid oxygen (LOX) collects at the warmer bottom.

The fractions are further purified by vaporizing the liquid oxygen LOX from the bottom of the separation column 5 in a vaporizer (reboiler) 6 and the gaseous nitrogen is liquefied in an "overhead" condenser 7. The vaporized, gaseous oxygen (GOX) and the liquefied nitrogen (LIN) are supplied again to the separation column 5, where the rectification is repeated until the desired purity is achieved.

Correspondingly pure fluids may be drawn off from the bottom or top of the separation column 5 and stored for further use in liquid tanks 8, 9.

An oxygen-argon mixture O/Ar may, for example, furthermore be drawn off from the separation column 5, from which mixture high purity argon may be obtained in a separate method. Separate columns can also be used for obtaining the noble gases xenon, krypton, helium and/or neon as products.

Newly drawn in air (see above) is cooled by drawing off a proportion of the obtained nitrogen (GAN) and recycling it to the main heat exchanger in the main heat exchanger module 1.

Figure 2:
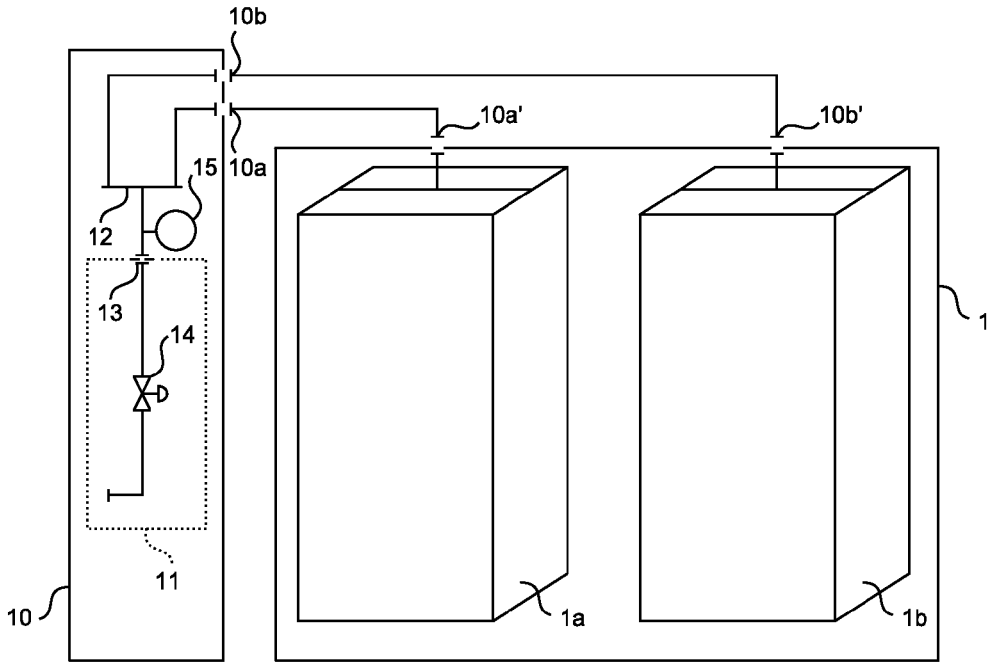
FIG. 2 shows a schematic diagram of a piping module with two main heat exchangers according to one embodiment of the invention.

FIG. 2 shows a schematic diagram of a piping module and two main heat exchangers 1*a* and 1*b* according to an embodiment of the invention. The piping module is designated overall as 10, while a main heat exchanger module, which contains the two main heat exchangers 1*a* and 1*b*, is designated as 1. Although FIG. 2 shows only two main heat exchangers 1*a* and 1*b*, the invention may also be carried out with more than two or only one main heat exchanger(s). The main heat exchanger module 1 may for example be constructed in the form of a cold box, as explained above.

The piping module 10 may be made up of a base module 11 and a fluid manifold module 12 which are connected to one another via a suitable connection 13. Central components such as corresponding valves 14 may be arranged in the base module 11. FIG. 2 here shows only one line in the base module 11, which divides into two lines in the fluid manifold module 12. As explained, a main heat exchanger module 1 or the main heat exchangers 1*a* or 1*b* arranged therein may, however, in practice be passed through by a plurality of different fluid streams countercurrently to one another, such that a plurality of the stated lines are also present. As explained, one set of ports is provided in the fluid manifold module 12 for each main heat exchanger 1*a* or 1*b* to be connected. The piping module 10 may be mounted on a suitable frame and/or may be enclosed in a suitable container for transportation to the site of use, e.g. on a truck. The piping module may, as mentioned, be of a flat construction in a horizontal direction and/or may generally be optimized for fitting in an available space within an air separation plant. The piping module 10, furthermore, is adapted to the specific parameters of the fluids guided through its fluid lines. Typically, at least one of the fluids may be provided by the main compressor with a pressure of at least 6 bar, but in specific cases also more than 6 bar, e.g. at least 10 bar. In other cases, e.g. when using "internal"

compression as mentioned above, also the fluids coming from the main heat exchanger may be provided with such pressures. Therefore, a corresponding fluid line is adapted to be operated under such pressure. At least one of the fluids may comprise an elevated oxygen content or may be pure oxygen. Therefore, a corresponding fluid line is adapted to be operated with such a fluid and comprise e.g. oil and grease free components.

The piping module 10 may furthermore comprise (in the main module 11 and/or the fluid manifold module 12) at least one pressure, temperature and/or flow controller 15. Fire-protected oxygen valves are, for example, not shown. Such fire-protected oxygen valves are, e.g., also provided in the fluid lines in the main module 11 and/or in the fluid manifold module 12.

The fluid manifold module 12 comprises, as mentioned, a set of ports 10*a* or 10*b* for the main heat exchangers 1*a* or 1*b* to be connected. These may be connected very straightforwardly with corresponding ports 10*a*' or 10*b*' on the main heat exchanger 1*a* or 1*b* to be connected.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The entire disclosures of all applications, patents and publications, cited herein and of corresponding German patent application DE 10 2012 008 416.1, filed Apr. 27, 2012, are incorporated by reference herein.

The invention claimed is:

1. A prefabricated piping module (10) constructed for use in an air fractionation plant (100) having a warm part containing at least one main compressor and a cold part containing at least one main heat exchanger, said piping module being capable of linking at least two fluid ports (10*a*', 10*b*') of the at least one main heat exchanger (1*a*, 1*b*) to at least two fluid lines in a warm part of the air fractionation plant (100), said piping module (10) comprising:

a prefabricated piping module having a main compressor side and a main heat exchanger side, at least two ports on the main compressor side of the piping module, which are couplable with the at least two fluid lines in the warm part of the air fractionation plant (100), at least two ports (10*a*, 10*b*) on the main heat exchanger side of the piping module, which are couplable with the at least two fluid ports (10*a*', 10*b*') of the at least one main heat exchanger (1*a*, 1*b*) in the cold part of the air fractionation plant (100), and at least two fluid lines connecting said at least two ports on the main compressor side to said at least two ports (10*a*, 10*b*) on the main heat exchanger side, wherein said piping module is in the form of a pipping skid, wherein said piping module optionally comprises shut-off means for shutting off individual fluid lines and/or adjusting means for adjusting a fluid stream, and wherein said piping module does not comprise compressors, expansion machines, heating devices, coolers, or heat exchangers.

2. The piping module (10) according to claim 1, wherein said piping module is constructed to be arranged beside the at least one main heat exchanger (1*a*, 1*b*) of the air fractionation plant (100), and said piping module having an upper region wherein the ports (10*a*, 10*b*) on the main heat exchanger side are arranged on said upper region of the piping module (10).

3. The piping module (10) according to claim 1, which is arranged for linking at least two fluid ports (10*a*', 10*b*') of the at least one main heat exchanger (1*a*, 1*b*) to a common fluid line in the warm part of the air fractionation plant (100).

4. The piping module (10) according to claim 3, which comprises at least one fluid manifold (12), which is arranged for linking at least two fluid ports (10*a*', 10*b*') of the at least one main heat exchanger (1*a*, 1*b*) to said common fluid line in the warm part of the air fractionation plant (100) and, in each case, couples at least two ports (10*a*, 10*b*) on the main heat exchanger side of said piping module with a port on the main compressor side of said piping module.

5. The piping module (10) according to claim 4, in which the at least one fluid manifold is constructed as a fluid manifold module (12) which is linkable to a base module (11) which comprises the at least two ports on the main compressor side of said piping module.

6. The piping module (10) according to claim 1, wherein said piping module is capable of linking a plurality main heat exchangers in the air fractionation plant, each of the main heat exchangers having a plurality of fluid ports (10*a*', 10*b*'), said piping module a plurality of sets of ports on the main heat exchanger side of said piping module, and each one of the plurality of sets of ports having a plurality of ports (10*a*, 10*b*) corresponding to the a plurality of fluid ports (10*a*', 10*b*') on each of the main heat exchangers, whereby said piping module can be linked to the plurality of m main heat exchangers (1*a*, 1*b*).

7. The piping module (10) according to claim 1, wherein the fluid lines, connecting the at least two ports on the main compressor side of said piping module and the at least two ports (10*a*, 10*b*) on the main heat exchanger side of said piping module, comprise at least one feed line for passage of compressed, prepurified and/or precooled air and at least one discharge line for passage of cooled nitrogen (GAN).

8. The piping module (10) according to claim 1, wherein said piping module further comprises at least one fire-protected oxygen transfer valve.

9. An air fractionation plant (100) comprising:

at least one piping module (10) according to claim 1, at least one main heat exchanger (1*a*, 1*b*) connected to said at least one piping module (10), and a warm part of said fractionation plant comprising a main compressor which is also connected to said at least one piping module (10), whereby at least two fluid ports (10*a*', 10*b*') of said at least one main heat exchanger (1*a*, 1*b*) are in fluid communication with at least two fluid lines in the warm part of said fractionation plant by means of said piping module (10).

10. A method for erecting an air fractionation plant (100) according to claim 9, comprising:

providing at least one main heat exchanger (1*a*, 1*b*) and at least one piping module (10), fluidly connecting said at least one main heat exchanger (1*a*, 1*b*) with said at least one piping module (10), whereby at least two fluid ports (10*a*', 10*b*') of said at least one main heat exchanger (1*a*, 1*b*) are placed in fluid communication with at least two fluid lines in the warm part of said fractionation plant by means of said piping module (10).

11. The method according to claim 10, wherein in said fluidly connecting of said at least one main heat exchanger (1*a*, 1*b*) with said at least one piping module (10), said at least two ports (10*a*, 10*b*) on the main heat exchanger side of said piping module are coupled with said at least two fluid ports (10*a*', 10*b*') of said at least one main heat exchanger (1*a*, 1*b*) by connection pipes with correspondingly standardized flanges.

12. The prefabricated piping module of claim 1, wherein the main heat exchanger is formed from at least two parallel blocks.

* * * * *